US011509984B2

(12) United States Patent
Chen et al.

(10) Patent No.: US 11,509,984 B2
(45) Date of Patent: Nov. 22, 2022

(54) MICROPHONE MODULE

(71) Applicant: Merry Electronics(Shenzhen) Co., Ltd., ShenZhen (CN)

(72) Inventors: Jen-Yi Chen, Taichung (TW); Chao-Sen Chang, Taichung (TW); Kai-Yu Jiang, Taichung (TW); Yung-Hsiang Chang, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 17/156,650

(22) Filed: Jan. 25, 2021

(65) Prior Publication Data

US 2022/0191605 A1 Jun. 16, 2022

(30) Foreign Application Priority Data

Dec. 10, 2020 (TW) ..... 109143609

(51) Int. Cl.
*H04R 1/04* (2006.01)
*H04R 1/08* (2006.01)
*H04R 1/02* (2006.01)

(52) U.S. Cl.
CPC ..... *H04R 1/08* (2013.01); *H04R 1/02* (2013.01); *H04R 1/04* (2013.01)

(58) Field of Classification Search
CPC . H04R 1/00; H04R 1/005; H04R 1/02; H04R 1/04; H04R 1/08; H04R 1/083; H04R 1/086; H04R 1/104; H04R 1/406; H04R 1/222; H04R 3/005; H04R 19/00; H04R 19/005; H04R 19/04; B81B 2201/047; B81B 2207/07; B81B 2207/012
See application file for complete search history.

(56) References Cited

U.S. PATENT DOCUMENTS

2010/0284553 A1* 11/2010 Conti ..... H04R 19/005 381/174
2010/0303274 A1* 12/2010 Ryan ..... H04R 1/222 381/361
2015/0023523 A1* 1/2015 Elian ..... B81B 7/0061 381/91

(Continued)

FOREIGN PATENT DOCUMENTS

CN 106612485 A * 5/2017

*Primary Examiner* — Thang V Tran
(74) *Attorney, Agent, or Firm* — JCIPRNET

(57) ABSTRACT

A microphone module, including a substrate assembly, two sensing structures, and two housings, is provided. The substrate assembly has at least one through hole and at least one circuit structure electrically connected to at least one pad. The through hole includes two holes formed on opposite sides of the substrate assembly. The sensing structures are disposed on and cover the two holes. The two sensing structures and the through hole collectively form a communicating cavity. A size of the communicating cavity in an axial direction is greater than that in a radial direction. The two housings are respectively disposed on the opposite sides of the substrate assembly and respectively shield the two sensing structures. Each of the housings, the substrate assembly, and the corresponding sensing structure form an inner cavity. The housings each has a sound hole. The inner cavity communicates with the outside through the sound hole.

9 Claims, 9 Drawing Sheets

(56) References Cited

U.S. PATENT DOCUMENTS

| | | | | |
|---|---|---|---|---|
| 2017/0318396 | A1* | 11/2017 | Brioschi | H04R 3/005 |
| 2018/0167723 | A1* | 6/2018 | Wang | H04R 1/2876 |
| 2021/0195322 | A1* | 6/2021 | Liu | H04R 1/04 |

* cited by examiner

MICROPHONE MODULE

CROSS-REFERENCE TO RELATED APPLICATION

This application claims the priority benefit of Taiwan application serial no. 109143609, filed on Dec. 10, 2020. The entirety of the above-mentioned patent application is hereby incorporated by reference herein and made a part of this specification.

BACKGROUND

Technical Field

The disclosure relates to a microphone module, and more particularly to a microphone module with directional sensing.

Description of Related Art

Most of the existing microphones use a single sensing structure to receive sound from the outside. The sound enables the diaphragm of the sensing structure in the microphone module to vibrate, and the signal is then transmitted to the signal processing unit. However, there is only one sensing structure, and the vibration of the diaphragm of the sensing structure will reduce the sensitivity due to the high air resistance in the cavity, resulting in a less clear signal transmitted.

SUMMARY

The disclosure provides a microphone module with good sensing sensitivity.

A microphone module of the disclosure includes a substrate assembly, two sensing structures, and two housings. The substrate assembly has at least one through hole and at least one circuit structure electrically connected to at least one pad. The through hole includes two holes formed on opposite sides of the substrate assembly. The sensing structures are respectively disposed on the two holes and cover the holes. The two sensing structures and the through hole collectively form a communicating cavity. A size of the communicating cavity in an axial direction is greater than a size of the communicating cavity in a radial direction. The two housings are respectively disposed on the opposite sides of the substrate assembly and respectively shield the two sensing structures. Each of the housings, the substrate assembly, and the corresponding sensing structure form an inner cavity. The housings each have a sound hole. The inner cavity communicates with the outside through the sound hole.

In an embodiment of the disclosure, the microphone module further includes two signal processing elements. The two signal processing elements are respectively electrically connected to the two sensing structures and independently process a signal from the two sensing structures.

In an embodiment of the disclosure, the substrate assembly includes two carrier substrates and an intermediate substrate. The intermediate substrate is sandwiched between the two carrier substrates. The through hole extends through the two carrier substrates and the intermediate substrate. The at least one pad is formed on the intermediate substrate.

In an embodiment of the disclosure, the substrate assembly includes two carrier substrates, two intermediate substrates, and a thickening layer. The two intermediate substrates are sandwiched between the two carrier substrates. The thickening layer is sandwiched between the two intermediate substrates. The through hole extends through the two carrier substrates, the two intermediate substrates, and the thickening layer. The number of the at least one pad is at least two. The at least two pads are respectively formed on the two intermediate substrates.

In an embodiment of the disclosure, the substrate assembly includes two carrier substrates and a thickening layer. The thickening layer is sandwiched between the two carrier substrates. The through hole extends through the two carrier substrates and the thickening layer. The number of pads is at least two. The two pads are respectively formed on opposite sides of the thickening layer.

In an embodiment of the disclosure, the number of the circuit structure is at least two groups. The two groups of the circuit structures respectively extend from the two carrier substrates to the two housings. The at least two pads are respectively formed on the two housings and on the same surface as each of the sound holes.

In an embodiment of the disclosure, the at least two pads are respectively formed on the two carrier substrates.

In an embodiment of the disclosure, the substrate assembly includes a carrier substrate and a thickening layer. The thickening layer is disposed on the carrier substrate. The through hole extends through the carrier substrate and the thickening layer, and the two holes are respectively formed on the carrier substrate and the thickening layer.

In an embodiment of the disclosure, the substrate assembly includes two carrier substrates. The through hole extends through the two carrier substrates, and the two holes are respectively formed on the two carrier substrates. The at least one pad is formed on one of the two carrier substrates.

In an embodiment of the disclosure, the substrate assembly includes a carrier substrate. The two holes are respectively formed on the opposite sides of the carrier substrate. The circuit structure extends on the carrier substrate. The at least one pad is formed on the carrier substrate.

In an embodiment of the disclosure, the microphone module further includes an air-permeable element. The air-permeable element covers the sound hole of one of the two housings.

In an embodiment of the disclosure, the microphone module further includes a seal element. The seal element covers the sound hole of one of the two housings.

Based on the above, the microphone module of the disclosure is respectively equipped with the sensing structures on the opposite sides of the substrate assembly, and the communicating cavity is formed by the through hole and the two sensing structures of the substrate assembly. Thereby, when the sound wave is transmitted to the sensing structure located at one end of the communicating cavity and enables the diaphragm of the sensing structure to vibrate, the diaphragm of the sensing structure located at the other end of the communicating cavity correspondingly vibrates with the linkage of the air in the communicating cavity, so that when the diaphragm of each of the sensing structures vibrates, the diaphragm is subjected to the pushing or pulling force exerted by the diaphragm of the other sensing structure to the air in the communicating cavity, so as to have a greater amplitude. In order to effectively increase the vibrational amplitudes of the diaphragms of the two sensing structures, the air in the communicating cavity is substantially not communicated with the outside. Therefore, compared with the conventional microphone module with only a single sensing structure, each of the sensing structures of the microphone module of the disclosure has better sensing sensitivity, which helps to improve the signal to noise ratio (SNR) of the microphone module. In addition, the communicating cavity is a back cavity shared by the two sensing structures. By designing the size of the communicating cavity in the axial direction to be greater, the two sensing structures may be farther apart to improve the directional sensing effect, and by designing the sizes of two inner cavities to be smaller, the volume of the two inner cavities may be reduced as much as possible to achieve the effect of extending the high-frequency response curve, so as to improve the overall directional sensing effect of the microphone module.

In order for the aforementioned features and advantages of the disclosure to be more comprehensible, embodiments accompanied with drawings are described in detail below.

DETAILED DESCRIPTION OF DISCLOSED EMBODIMENTS

Figure 1:
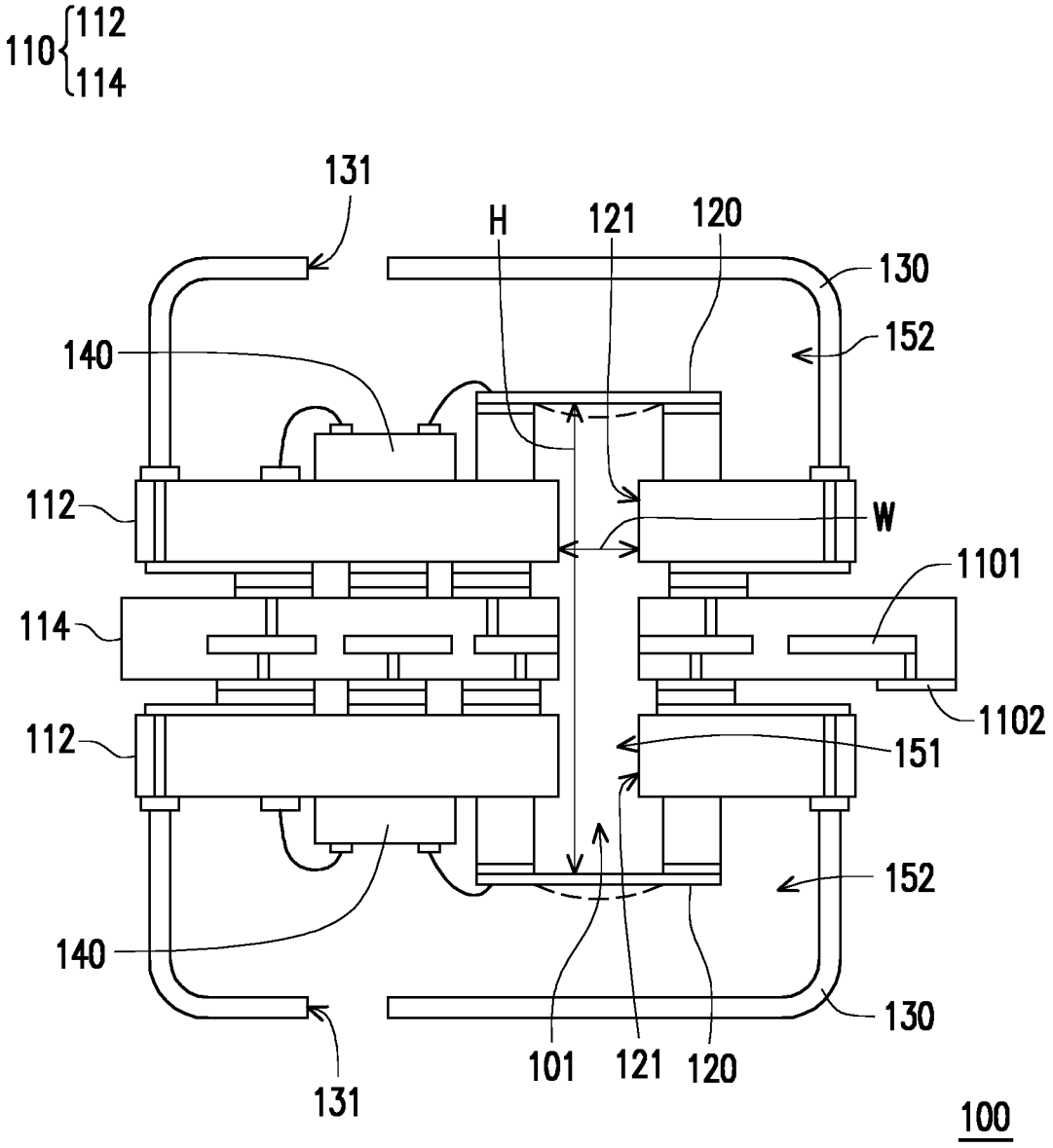
FIG. 1 is a schematic view of a microphone module according to an embodiment of the disclosure.

FIG. 1 is a schematic view of a microphone module according to an embodiment of the disclosure. Referring to FIG. 1, a microphone module 100 of this embodiment includes a substrate assembly 110, two sensing structures 120, and two housings 130. The two sensing structures 120 are respectively disposed on opposite sides of the substrate assembly 110. The two housings 130 are respectively disposed on the opposite sides of the substrate assembly 110 and respectively shield the two sensing structures 120. Each of the housings 130, the substrate assembly 110, and the corresponding sensing structure 120 form an inner cavity 152, and the housings 130 each has a sound hole 131. The inner cavity 152 communicates with the outside through the sound hole 131. A sound wave from the outside enters the inner cavity 152 from the sound hole 131, so that a diaphragm of the sensing structure 120 vibrates to generate audio.

As shown in FIG. 1, the substrate assembly 110 of this embodiment has at least one through hole 101 and at least one circuit structure 1101 electrically connected to at least one pad 1102. The through hole 101 includes two holes 121 formed on the opposite sides of the substrate assembly 110. The sensing structures 120 are respectively disposed on the two holes 121 and cover the holes 121. The two sensing structures 120 and the through hole 101 collectively form a communicating cavity 151. The communicating cavity 151 is a back cavity shared by the two sensing structures 120. With such configuration, when the sound wave is transmitted to the sensing structure 120 located at one end of the communicating cavity 151, so that the diaphragm of the sensing structure 120 vibrates (as shown by the dashed line at one of the sensing structures in FIG. 1), a diaphragm of the sensing structure 120 located at the other end of the communicating cavity 151 correspondingly vibrates (as shown by the dashed line at the other sensing structure in FIG. 1) with the linkage of the air in the communicating cavity 151, so that when the diaphragm of each of the sensing structures 120 vibrates, the diaphragm is subjected to the pushing or pulling force by the other sensing structure 120 to have a greater amplitude. In order to effectively increase the vibrational amplitudes of the diaphragms of the two sensing structures 120, the air in the communicating cavity 151 is substantially not communicated with the outside. Therefore, compared with a conventional microphone module with only a single sensing structure, each of the sensing structures 120 of the microphone module 100 of this embodiment has better sensing sensitivity, which helps to improve the signal to noise ratio (SNR) of the microphone module.

In addition, as shown in FIG. 1, a size H of the communicating cavity 151 of this embodiment in an axial direction is greater than a size W of the communicating cavity 151 in a radial direction. By designing the size H of the communicating cavity 151 in the axial direction to be greater, the two sensing structures 120 may be farther apart to improve the directional sensing effect, and by designing the sizes of two inner cavities to be smaller, the volume of the inner cavity 152 may be reduced as much as possible to achieve a purpose of extending the high-frequency response curve, so as improve the overall directional sensing effect of the microphone module.

As shown in FIG. 1, the microphone module 100 of this embodiment includes two signal processing elements 140. The two signal processing elements 140 are respectively electrically connected to the two sensing structures 120 and independently process a signal from the two sensing structures 120.

A single load of the signal processing element 140 is smaller by using the two sensing structures 120 at the same time. Moreover, an acoustic overload point (AOP) may be increased, for example, by 6 dB because the two sensing structures 120 respectively use the two signal processing elements 140. Generally speaking, exceeding the AOP causes the audio to be distorted, and the complete audio cannot be intercepted, resulting in broken sound. Increasing the AOP may effectively improve the effect of microphone voice recognition. In addition, a directional output, which may be unidirectional, bidirectional, or omnidirectional, of the microphone may also be adjusted by the delay of the two signal processing elements 140.

In this embodiment, the substrate assembly 110 includes two carrier substrates 112 and an intermediate substrate 114. The intermediate substrate 114 is sandwiched between the two carrier substrates 112. The through hole 101 extends through the two carrier substrates 112 and the intermediate substrate 114. The at least one pad 1102 is formed on the intermediate substrate 114. In other embodiments, the substrate assembly may be configured in other ways, which are described with the drawings hereinafter.

Figure 2:
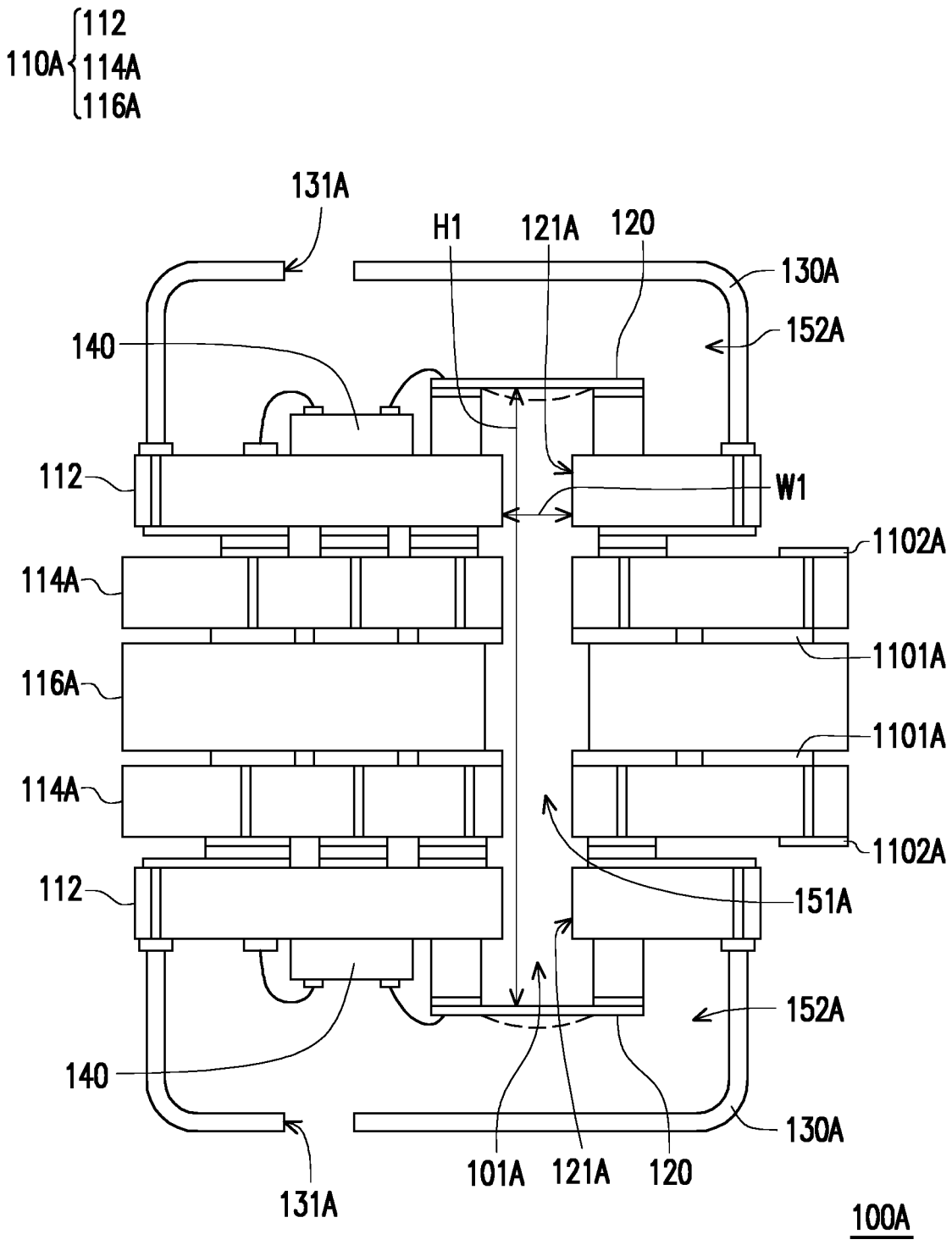
FIG. 2 is a schematic view of a microphone module according to another embodiment of the disclosure.

FIG. 2 is a schematic view of a microphone module according to another embodiment of the disclosure. A through hole 101A, a sensing structure 120, a hole 121A, a housing 130A, a sound hole 131A, a signal processing element 140, a communicating cavity 151A, an inner cavity 152A, a size H1, and a size W1 in FIG. 2 are similar in terms of configuration and functions to the through hole 101, the sensing structure 120, the hole 121, the housing 130, the sound hole 131, the signal processing element 140, the communicating cavity 151, the inner cavity 152, the size H, and the size W in FIG. 1, and repeated description is omitted here. The difference between a microphone module 100A of FIG. 2 and the microphone module 100 of FIG. 1 is that a substrate assembly 110A in the microphone module 100A of FIG. 2 includes two carrier substrates 112, two intermediate substrates 114A, and a thickening layer 116A. The two intermediate substrates 114A are sandwiched between the two carrier substrates 112. The thickening layer 116A is sandwiched between the two intermediate substrates 114A. Moreover, the through hole 101A extends through the two carrier substrates 112, the two intermediate substrates 114A, and the thickening layer 116A. The thickening layer 116A may increase a distance between the two sensing structures 120, that is, the size H1, which improves the sensing sensitivity. Moreover, a signal of the signal processing element 140 is connected to at least one pad 1102A by a circuit structure 1101A, and the number of the at least one pad 1102A in this embodiment is at least two. Moreover, the two pads 1102A are respectively formed on the two intermediate substrates 114A.

Figure 3:
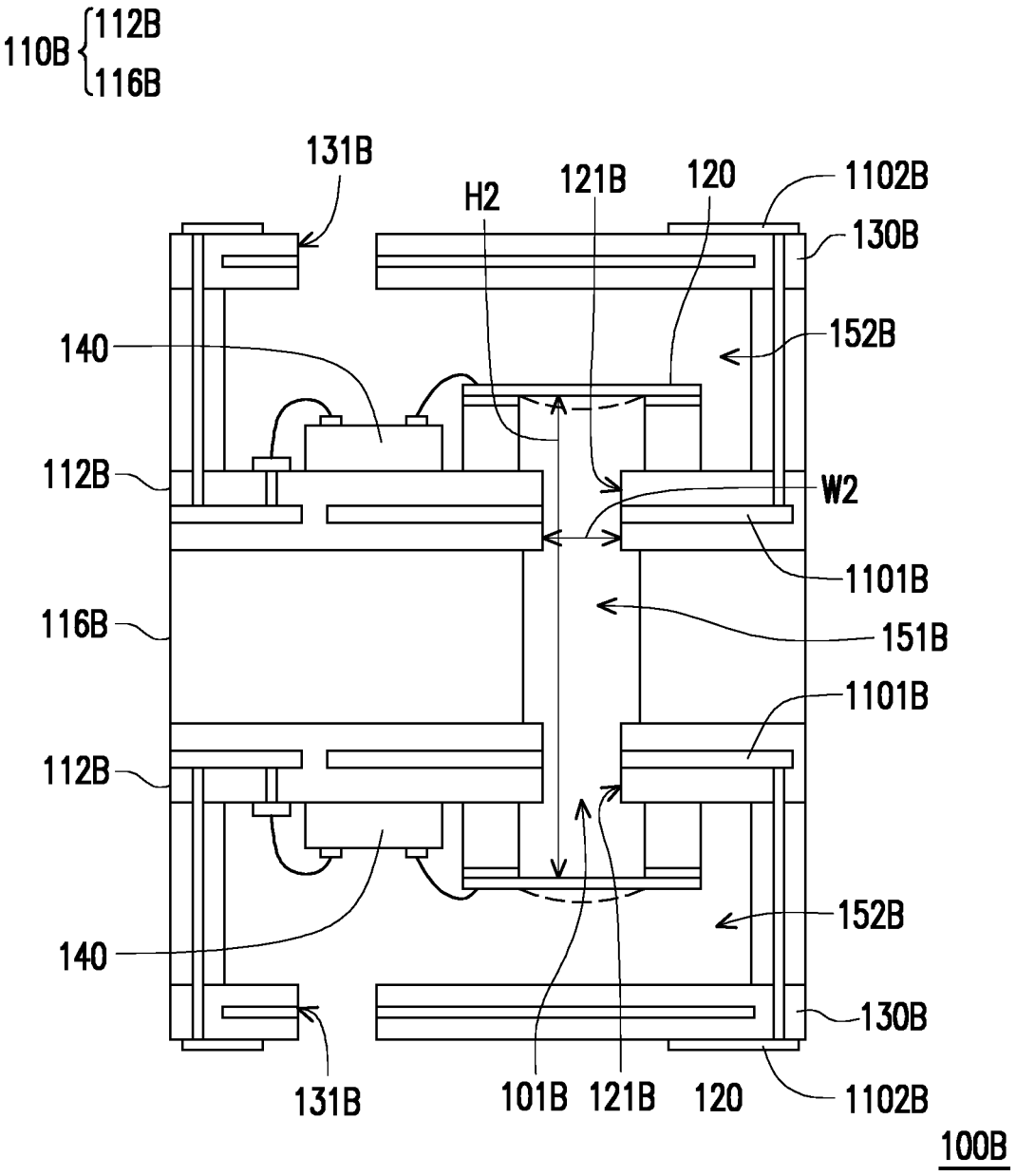
FIG. 3 is a schematic view of a microphone module according to another embodiment of the disclosure.

FIG. 3 is a schematic view of a microphone module according to another embodiment of the disclosure. A through hole 101B, a sensing structure 120, a hole 121B, a housing 130B, a sound hole 131B, a signal processing element 140, a communicating cavity 151B, an inner cavity 152B, a size H2, and a size W2 in FIG. 3 are similar in terms of configuration and functions to the through hole 101, the sensing structure 120, the hole 121, the housing 130, the sound hole 131, the signal processing element 140, the communicating cavity 151, the inner cavity 152, the size H, and the size W in FIG. 1, and repeated description is omitted here. The difference between a microphone module 100B of FIG. 3 and the microphone module 100 of FIG. 1 is that a substrate assembly 110B in the microphone module 100B of FIG. 3 includes two carrier substrates 112B and a thickening layer 116B. The thickening layer 116B is sandwiched between the two carrier substrates 112B. The through hole 101B extends through the two carrier substrates 112B and the thickening layer 116B. Moreover, the number of pads 1102B is at least two, which are respectively formed on opposite sides of the thickening layer. In particular, the number of a circuit structure 1101B is at least two groups, and the two groups of the circuit structures 1101B respectively extend from the two carrier substrates 112B to the two housings 130B. The two pads 1102B are respectively formed on the two housings 130B and on a same surface as each sound hole 131B. In detail, a structure of the housing 130B extends from the carrier substrate 112B, while the circuit structure 1101B runs along the housing 130B to a side opposite to the carrier substrate 112B, and has the pad 1102B formed on the housing 130B and located on a same surface.

Figure 4:
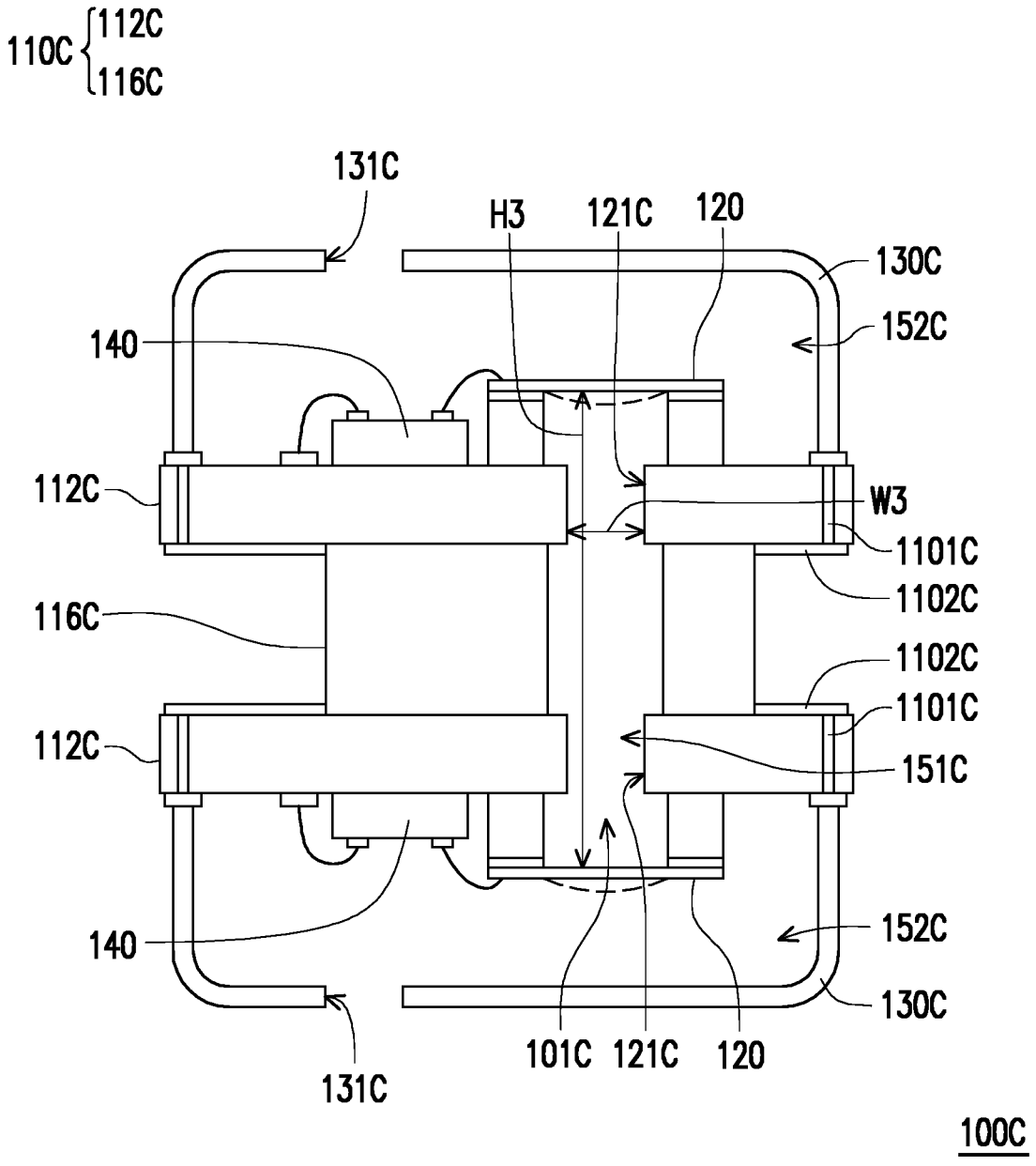
FIG. 4 is a schematic view of a microphone module according to another embodiment of the disclosure.

FIG. 4 is a schematic view of a microphone module according to another embodiment of the disclosure. A through hole 101C, a sensing structure 120, a hole 121C, a housing 130C, a sound hole 131C, a signal processing element 140, a communicating cavity 151C, an inner cavity 152C, a size H3, and a size W3 in FIG. 4 are similar in terms of configuration and functions to the through hole 101, the sensing structure 120, the hole 121, the housing 130, the sound hole 131, the signal processing element 140, the communicating cavity 151, the inner cavity 152, the size H, and the size W in FIG. 1, and repeated description is omitted here. The difference between a microphone module 100C of FIG. 4 and the microphone module 100 of FIG. 1 is that a substrate assembly 110C in the microphone module 100C of FIG. 4 includes two carrier substrates 112C and a thickening layer 116C. The thickening layer 116C is sandwiched between the two carrier substrates 112C. The through hole 101C extends through the two carrier substrates 112C and the thickening layer 116C. Moreover, the number of pads 1102C is at least two, which are respectively formed on opposite sides of the thickening layer, and formed on the two carrier substrates 112C.

Figure 5:
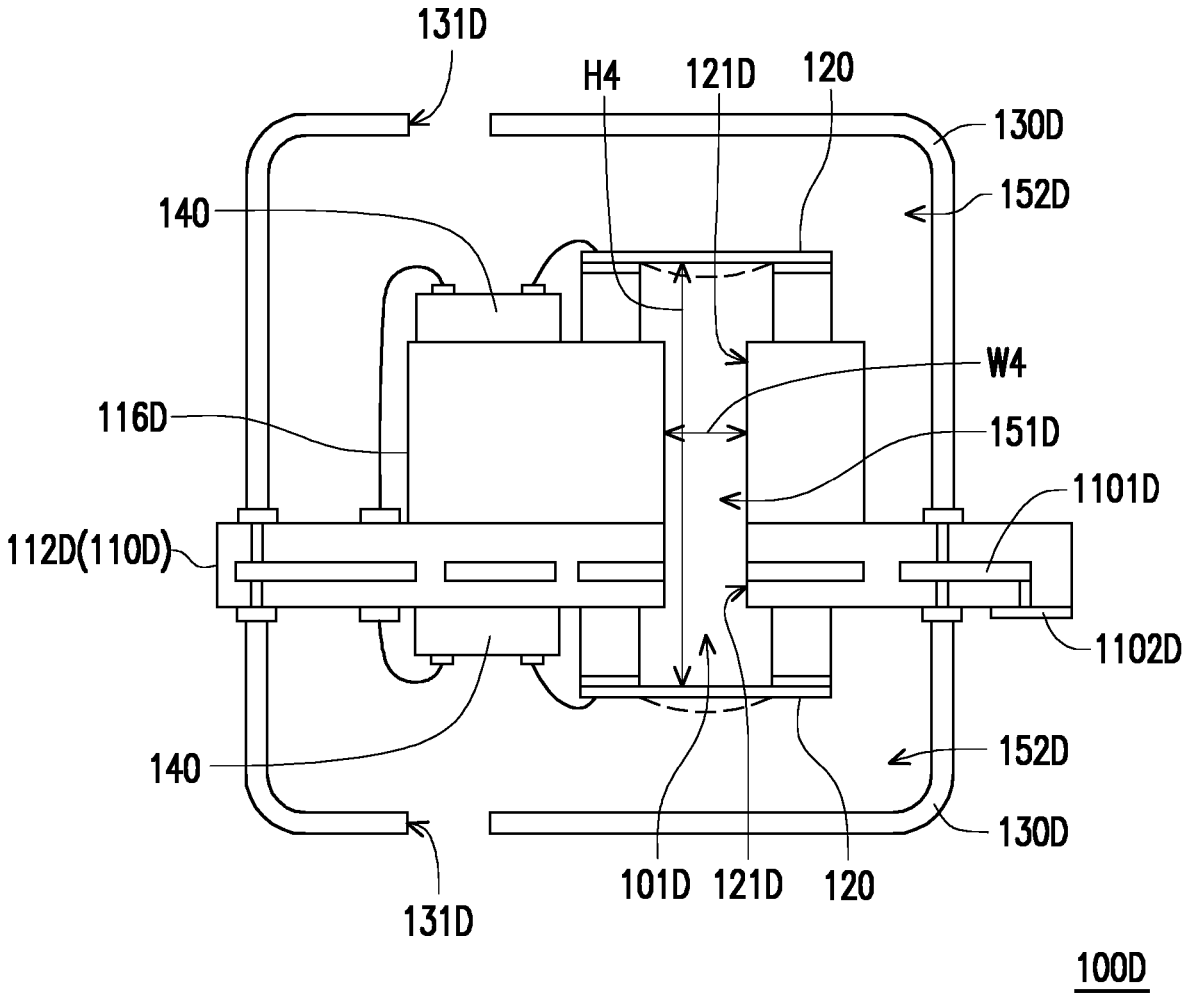
FIG. 5 is a schematic view of a microphone module according to another embodiment of the disclosure.

FIG. 5 is a schematic view of a microphone module according to another embodiment of the disclosure. A through hole 101D, a sensing structure 120, a hole 121D, a housing 130D, a sound hole 131D, a signal processing element 140, a communicating cavity 151D, an inner cavity 152D, a size H4, and a size W4 in FIG. 5 are similar in terms of configuration and functions to the through hole 101, the sensing structure 120, the hole 121, the housing 130, the sound hole 131, the signal processing element 140, the communicating cavity 151, the inner cavity 152, the size H, and the size W in FIG. 1, and repeated description is omitted here. The difference between a microphone module 100D of FIG. 5 and the microphone module 100 of FIG. 1 is that a substrate assembly 110D in the microphone module 100D of FIG. 5 includes a carrier substrate 112D and a thickening layer 116D. The thickening layer 116D is disposed on the carrier substrate 112D. The through hole 101D extends through the carrier substrate 112D and the thickening layer 116D, and the two holes 121D of the through hole are respectively formed on the carrier substrate 112D and the thickening layer 116D. The thickening layer 116D and the carrier substrate 112D are located in two different directions, and both have the sensing structure 120 and the signal processing element 140 thereon.

Figure 6:
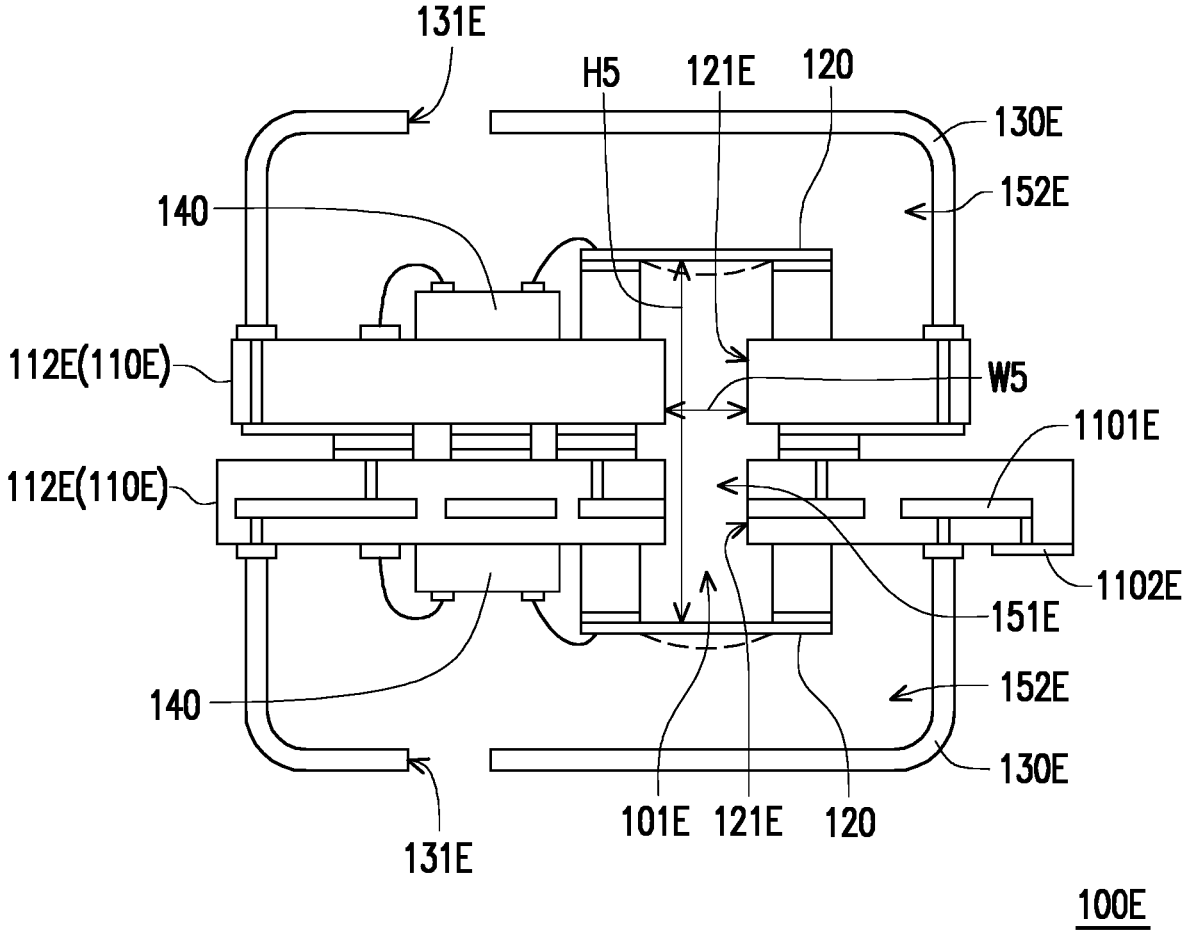
FIG. 6 is a schematic view of a microphone module according to another embodiment of the disclosure.

FIG. 6 is a schematic view of a microphone module according to another embodiment of the disclosure. A through hole 101E, a sensing structure 120, a hole 121E, a housing 130E, a sound hole 131E, a signal processing element 140, a communicating cavity 151E, an inner cavity 152E, a size H5, and a sizeW5 in FIG. 6 are similar in terms of configuration and functions to the through hole 101, the sensing structure 120, the hole 121, the housing 130, the sound hole 131, the signal processing element 140, the communicating cavity 151, the inner cavity 152, the size H, and the size W in FIG. 1, and repeated description is omitted here. The difference between a microphone module 100E of FIG. 6 and the microphone module 100 of FIG. 1 is that a substrate assembly 110E of FIG. 6 includes two carrier substrates 112E. The through hole 101E extends through the two carrier substrates 112E, and two holes 121E are respectively formed on the two carrier substrates 112E. At least one pad 1102E is formed on one of the carrier substrates 112E.

Figure 7:
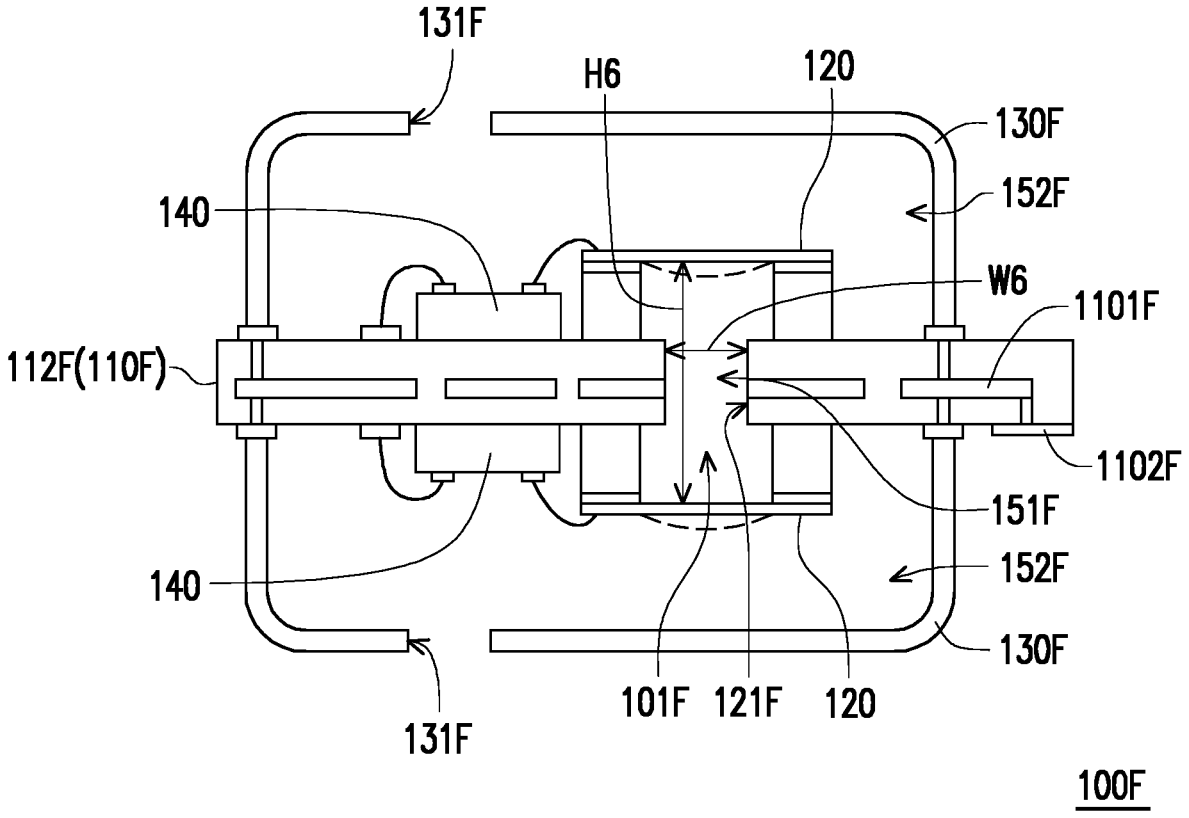
FIG. 7 is a schematic view of a microphone module according to another embodiment of the disclosure.

FIG. 7 is a schematic view of a microphone module according to another embodiment of the disclosure. A through hole 101F, a sensing structure 120, a hole 121F, a housing 130F, a sound hole 131F, a signal processing element 140, a communicating cavity 151F, an inner cavity 152F, a size H6, and a size W6 in FIG. 7 are similar in terms of configuration and functions to the through hole 101, the sensing structure 120, the hole 121, the housing 130, the sound hole 131, the signal processing element 140, the communicating cavity 151, the inner cavity 152, the size H, and the size W in FIG. 1, and repeated description is omitted here. The difference between a microphone module 100F of FIG. 7 and the microphone module 100 of FIG. 1 is that a substrate assembly 110F of FIG. 7 includes a carrier substrate 112F. The through hole 101F extends through the carrier substrate 112F, and two holes 121F are formed on opposite sides of the carrier substrates 112F. A circuit structure 1101F extends on the carrier substrate 112F, and at least one pad 1102F is formed on the carrier substrate 112F.

Figure 8:
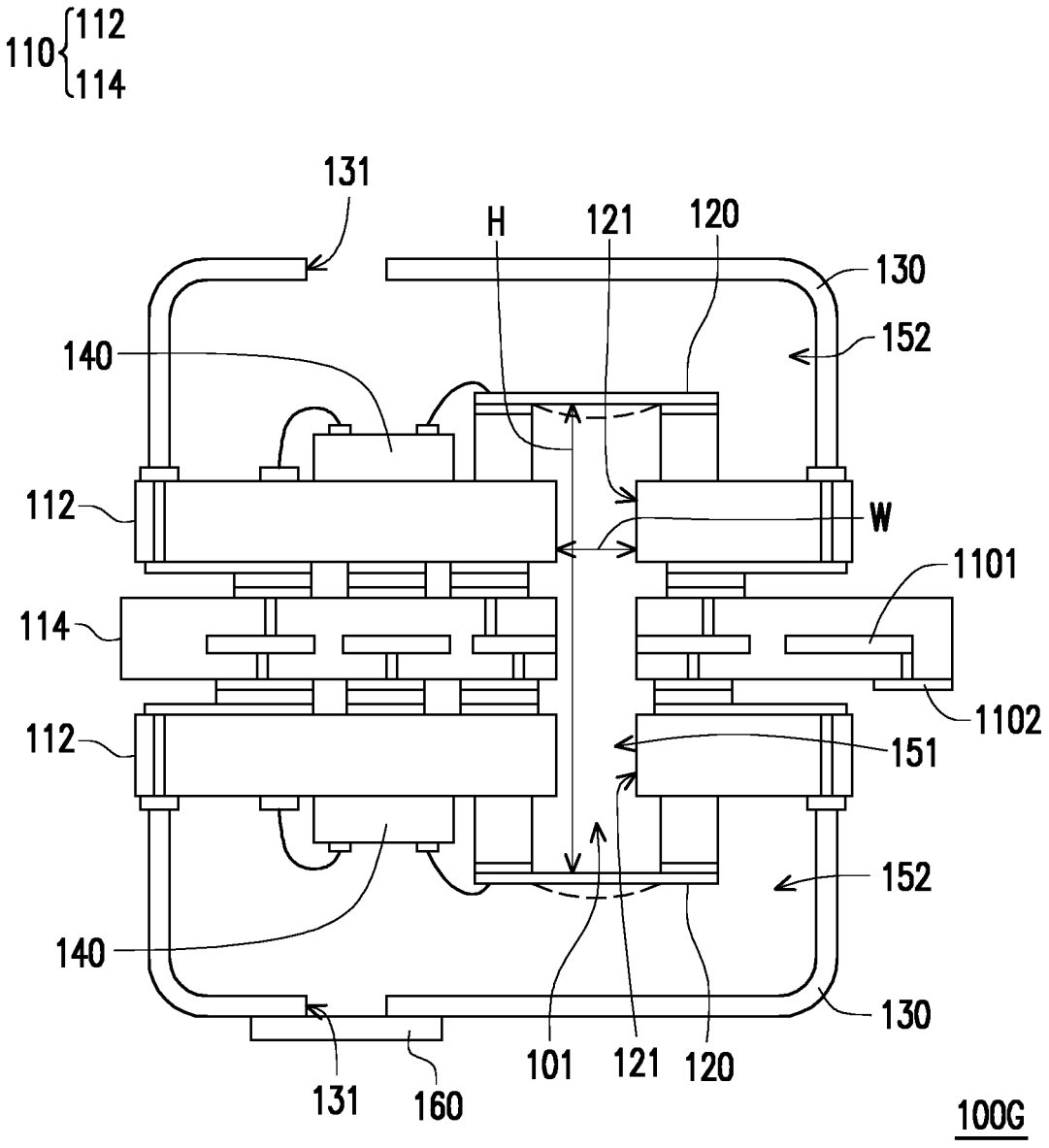
FIG. 8 is a schematic view of a microphone module according to another embodiment of the disclosure.

FIG. 8 is a schematic view of a microphone module according to another embodiment of the disclosure. A through hole 101, a substrate assembly 110, a sensing structure 120, a hole 121, a housing 130, a sound hole 131, a signal processing element 140, a communicating cavity 151, an inner cavity 152, a size H, and a size W in FIG. 8 are the same in terms of configuration and functions as the through hole 101, the substrate assembly 110, the sensing structure 120, the hole 121, the housing 130, the sound hole 131, the signal processing element 140, the communicating cavity 151, the inner cavity 152, the size H, and the size W in FIG. 1, and repeated description is omitted here. Referring to FIG. 8, in particular, a microphone module 100G of this embodiment has an air-permeable element 160. The air-permeable element 160 covers the sound hole 131 of one of the two housings 130. In a directional microphone module, a unidirectional microphone may be formed by covering one of the sound holes with an air-permeable element.

Figure 9:
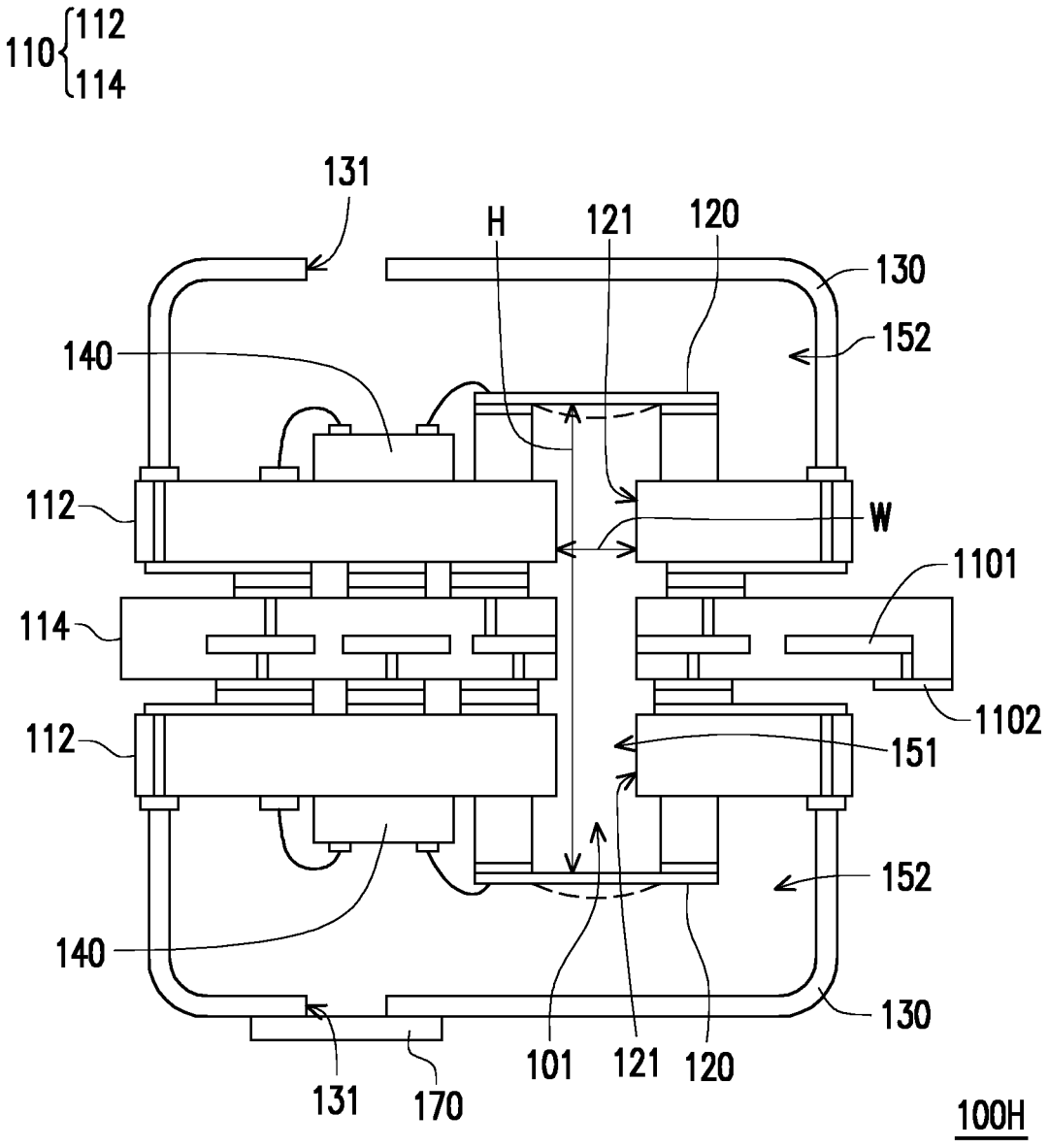
FIG. 9 is a schematic view of a microphone module according to another embodiment of the disclosure.

FIG. 9 is a schematic view of a microphone module according to another embodiment of the disclosure. A through hole 101, a substrate assembly 110, a sensing structure 120, a hole 121, a housing 130, a sound hole 131, a signal processing element 140, a communicating cavity 151, an inner cavity 152, a size H, and a size W in FIG. 9 are the same in terms of configuration and functions as the through hole 101, the substrate assembly 110, the sensing structure 120, the hole 121, the housing 130, the sound hole 131, the signal processing element 140, the communicating cavity 151, the inner cavity 152, the size H, and the size W in FIG. 1, and repeated description is omitted here. Referring to FIG. 9, in particular, a microphone module 100H of this embodiment has a seal element 170. The seal element 170 covers the sound hole 131 of one of the two housings 130. In the directional microphone module, an omnidirectional microphone may be formed by covering one of the sound holes with a seal element.

Based on the above, the microphone module of the disclosure is respectively equipped with the sensing structures on the opposite sides of the substrate assembly, and the communicating cavity is formed by the through hole and the two sensing structures of the substrate assembly. Thereby, when the sound wave is transmitted to the sensing structure located at one end of the communicating cavity and enables the diaphragm of the sensing structure to vibrate, the diaphragm of the sensing structure located at the other end of the communicating cavity correspondingly vibrates with the linkage of the air in the communicating cavity, so that when the diaphragm of each of the sensing structures vibrates, the diaphragm is subjected to the pushing or pulling force by the diaphragm of the other sensing structure to the air in the communicating cavity, so as to have a greater amplitude. In order to effectively increase the vibrational amplitudes of the diaphragms of the two sensing structures, the air in the communicating cavity is substantially not communicated with the outside. Therefore, compared with the conventional microphone module with only a single sensing structure, each of the sensing structures of the microphone module of the disclosure has better sensing sensitivity, which helps to improve the SNR of the microphone module. In addition, the communicating cavity is a back cavity shared by the two sensing structures. By designing the size of the communicating cavity in the axial direction to be greater, the two sensing structures may be farther apart to improve the directional sensing effect, and by designing the sizes of two inner cavities to be smaller, the volume of the two inner cavities may be reduced as much as possible to achieve the purpose of extending the high-frequency response curve, so as to improve the overall directional sensing effect of the microphone module. In addition, the single load of the signal processing element may smaller by using two sensing structures. Moreover, the AOP may be increased because the two sensing structures respectively use two signal processing elements. In addition, the directional output, which may be unidirectional, bidirectional, or omnidirectional, of the microphone may also be adjusted by the delay of the two signal processing elements.

What is claimed is:

1. A microphone module, comprising:

a substrate assembly, having at least one through hole and at least one circuit structure electrically connected to at least one pad, wherein the through hole comprises two holes formed on opposite sides of the substrate assembly;

two sensing structures, respectively disposed on the two holes and covering the holes, wherein the two sensing structures and the through hole collectively form a communicating cavity, and a size of the communicating cavity in an axial direction is greater than a size of the communicating cavity in a radial direction; and two housings, respectively disposed on the opposite sides of the substrate assembly and respectively shielding the two sensing structures, wherein each of the housings, the substrate assembly, and a corresponding sensing structure form an inner cavity, the housings each has a sound hole, and the inner cavity communicates with an outside through the sound hole, wherein the substrate assembly comprises two carrier substrates and an intermediate substrate, the intermediate substrate is sandwiched between the two carrier substrates, the through hole extends through the two carrier substrates and the intermediate substrate, and the at least one pad is formed on the intermediate substrate.

2. The microphone module according to claim 1, further comprising two signal processing elements, wherein the two signal processing elements are respectively electrically connected to the two sensing structures and independently process a signal from the two sensing structures.

3. The microphone module according to claim 1, wherein the two holes are respectively formed on the two carrier substrates.

4. The microphone module according to claim 1, further comprising an air-permeable element, wherein the air-permeable element covers the sound hole of one of the two housings.

5. The microphone module according to claim 1, further comprising a seal element, wherein the seal element covers the sound hole of one of the two housings.

6. A microphone module, comprising:

a substrate assembly, having at least one through hole and at least one circuit structure electrically connected to at least one pad, wherein the through hole comprises two holes formed on opposite sides of the substrate assembly;

two sensing structures, respectively disposed on the two holes and covering the holes, wherein the two sensing structures and the through hole collectively form a communicating cavity; and two housings, respectively disposed on the opposite sides of the substrate assembly and respectively shielding the two sensing structures, wherein each of the housings, the substrate assembly, and a corresponding sensing structure form an inner cavity, wherein the substrate assembly comprises two carrier substrates, at least one intermediate substrate, and a thickening layer, the intermediate substrate and the thickening layer are sandwiched between the two carrier substrates, and the through hole extends through the two carrier substrates, the intermediate substrate, and the thickening layer.

7. A microphone module, comprising:

a substrate assembly, having at least one through hole and at least one circuit structure electrically connected to at least one pad, wherein the through hole comprises two holes formed on opposite sides of the substrate assembly;

two sensing structures, respectively disposed on the two holes and covering the holes, wherein the two sensing structures and the through hole collectively form a communicating cavity; and two housings, respectively disposed on the opposite sides of the substrate assembly and respectively shielding the two sensing structures, wherein each of the housings, the substrate assembly, and a corresponding sensing structure form an inner cavity, wherein the substrate assembly comprises two carrier substrates and a thickening layer, the thickening layer is sandwiched between the two carrier substrates, the through hole extends through the two carrier substrates and the thickening layer, a number of the pad is at least two, and the two pads are respectively formed on opposite sides of the thickening layer.

8. The microphone module according to claim 7, wherein a number of the circuit structure is at least two groups, and the two groups of the circuit structures respectively extend from the two carrier substrates to the two housings, wherein the two housings each has a sound hole, and the at least two pads are respectively formed on the two housings and on a same surface as each sound hole.

9. The microphone module according to claim 7, wherein the at least two pads are respectively formed on the two carrier substrates.

* * * * *